United States Patent [19]

Royse

[11] Patent Number: 4,974,556

[45] Date of Patent: Dec. 4, 1990

[54] INTERNAL COMBUSTION ENGINE

[75] Inventor: Ralph L. Royse, May's Lick, Ky.

[73] Assignee: Royse Enterprises, Inc., May's Lick, Ky.

[21] Appl. No.: 447,214

[22] Filed: Dec. 7, 1989

[51] Int. Cl.[5] ..... F02B 75/26

[52] U.S. Cl. ..... 123/58 AM; 123/45 R; 123/65 B; 123/663; 123/559.1

[58] Field of Search ..... 123/58 AM, 58 BC, 56 C, 123/56 AC, 56 BC, 45 R, 663, 65 B, 559.1, 51 B, 51 BD

[56] References Cited

U.S. PATENT DOCUMENTS

| | | | |
|---|---|---|---|
| 1,374,915 | 4/1921 | Fasey . | |
| 1,445,686 | 2/1923 | Hult | 123/58 AM |
| 1,796,453 | 3/1931 | Goehler | 123/51 AA |
| 1,987,699 | 1/1935 | Moore | 123/58 AM |
| 2,068,038 | 1/1937 | Prothero et al. | 123/58 AM |
| 2,366,595 | 1/1945 | Christopher . | |
| 2,770,225 | 11/1956 | Palumbo | 123/58 AM |
| 3,040,721 | 6/1962 | Schotthoefer . | |
| 3,071,122 | 1/1963 | Lieberherr . | |
| 3,396,709 | 8/1968 | Robicheaux | 123/56 C |
| 4,526,141 | 7/1985 | Catchpole | 123/51 BA |
| 4,565,165 | 1/1986 | Papanicolaou | 123/51 BA |
| 4,610,223 | 9/1986 | Karlan | 123/58 AM |
| 4,887,558 | 12/1989 | Bernard | 123/52 B |

FOREIGN PATENT DOCUMENTS

| | | | |
|---|---|---|---|
| 697405 | 1/1931 | France | 123/58 A M |

*Primary Examiner*—David A. Okonsky

*Attorney, Agent, or Firm*—King and Schickli

[57] ABSTRACT

An internal combustion engine includes a pair of opposed piston assemblies that reciprocate within a single combustion chamber in an engine block. Each piston assembly includes an annular piston head that is received concentrically around a driveshaft which is rotatably driven by the piston assemblies. A supercharging chamber is concentrically disposed about each piston assembly. Pump rings connected to each piston assembly extend into the supercharging chambers and pump air through the chambers into an intake manifold as the piston assemblies reciprocate in each direction. Cooling lubricant is circulated through the engine block and piston assemblies as well as through and along the drive shaft so as to cool the combustion chamber on substantially all sides.

18 Claims, 3 Drawing Sheets

INTERNAL COMBUSTION ENGINE

TECHNICAL FIELD

The present invention relates generally to the combustion engine art and, more particularly, to a two stage internal combustion engine that is both compact and lightweight as well as fuel efficient and powerful for its size.

BACKGROUND OF THE INVENTION

Internal combustion engines including reciprocating pistons and rotating output shafts are well known in the art. These engines utilize a cycle including expansion, exhaust, intake and compression phases to convert the reciprocating motion of the engine pistons into rotational motion of the output shaft. Such engines conventionally use either four or two stroke cycles. In a four stroke cycle engine, the engine cycle is affected within four strokes of a working piston. In a two stroke cycle engine, all four phases of the cycle are affected within two strokes of a working piston.

Each of the two and four stroke engines have their own advantages and disadvantages. Two stroke engines include a relatively simple arrangement of ports for transferring an air fuel mixture charge and exhaust gases to and from the piston cylinder respectively. Advantageously, two stroke engines also develop power on each rotation of a crank shaft. This contrasts with four stroke engines which generate power only on every other rotation of the crank shaft. Accordingly, it should be appreciated that two stroke engines provide an improved power to weight ratio. Two stroke engines do, however, suffer from several disadvantages including poor scavenging characteristics and fuel efficiency. Two stroke engines also tend to generate combustion gases with a high pollution content.

In contrast, four stroke engines provide better scavenging and fuel efficiency. When in tune, four stroke engines also generate combustion gases with a relatively low pollution content when compared to two stroke counterparts. Four stroke engines do, however, also suffer from a number of disadvantages. For example, a four stroke engine includes a relatively complicated valve mechanism to regulate exhaust and intake charge flow. Additionally, as indicated above, four stroke engines only generate power on every other rotation of the crankshaft. Accordingly, they do not provide a desirable high power to weight ratio.

It has been found that the utilization of a cam and swashplate structure instead of a crankshaft permits greater flexibility in two and four stroke engine construction. For example, this structure makes it possible to arrange pistons in horizontally opposed construction. Such a construction exhibits a compactness not possible with crankshaft designs. Advantageously, such a construction also reduces the number of moving parts and provides greater power to weight ratio. Further, by adjusting the cam profile, port opening and closing positions may be set to obtain better scavenging in two stroke engine designs. Similarly, in four stroke engine designs, the utilization of an irregular cam plate profile makes it possible to provide expansion and intake strokes of significantly different lengths. Thus, the possibility of providing an engine with a greater expansion efficiency is attained.

One recent example of a horizontally opposed construction internal combustion engine is found in U.S. Pat. No. 4,565,165 to Papanicolaou. The Papanicolaou engine includes two cylinders. Each cylinder houses a pair of opposed piston assemblies. The cylinders include intake and exhaust ports in the cylinder walls that control the flow of air through the combustion chambers. As shown, the intake ports are connected to a supercharger that is attached to and driven by the output shaft of the engine.

While the engine disclosed in the Papanicolaou patent provides a high power to weight ratio with improved combustion efficiency and fuel economy, further improvements in engine designs particularly of the horizontally opposed construction are possible. More particularly, still better scavenging and air fuel charge flow are desirable. Similarly, so is a further improvement in fuel efficiency. Additionally, an engine of simpler construction that is both less expensive to produce and easier to manufacture and maintain is also desired.

SUMMARY OF THE INVENTION

Accordingly, it is a primary object of the present invention to provide an improved internal combustion engine of the horizontally opposed piston variety overcoming the above-described limitations and disadvantages of the prior art.

Another object of the present invention is to provide an internal combustion engine exhibiting improved efficiency and allowing better circulation of coolant to produce more power.

An additional object of the present invention is to provide an engine which minimizes the number of moving parts and consequently is less expensive to build and maintain while also being more reliable through the reduction of wear points.

Yet another object of the present invention is to provide a lightweight compact engine configuration with a high power to weight ratio.

An additional object of the present invention is to provide an improved internal combustion engine with integral supercharging and combusting pistons and a compression ratio that may be easily adjusted to provide the desired power output.

Yet another object of the present invention is to provide an internal combustion engine exhibiting an internal flywheel effect for improved efficiency and performance.

Still another object of the present invention is to provide an internal combustion engine having horizontally opposed reciprocating pistons received within a single combustion chamber constructed to provide an increase in porting area for better scavenging and air fuel charge flow out of and into the combustion chamber, respectively.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, a two stage internal combustion engine is provided. The engine comprises an engine block including a combustion chamber having both intake and exhaust ports. A pair of opposed piston assemblies are received for reciprocation within this chamber between top dead center and bottom dead center positions.

An intake manifold is provided in communication with the intake port. Means such as a spark plug or glow plug is provided in the combustion chamber for firing the fuel air charge delivered into the chamber.

The engine also includes a rotatable drive shaft. A cam mechanism connects the piston assemblies to the drive shaft and serves to convert the reciprocating motion of the piston assemblies into rotating motion of the drive shaft.

The engine is further characterized by the provision of a supercharging chamber concentrically disposed around each piston assembly received in the combustion chamber. Each supercharging chamber includes an inlet in communication with an air intake and an outlet in communication with the intake manifold. A valve system is provided for controlling the flow of air through the inlet and outlet of the supercharging chambers. Additionally, a pumping ring is mounted to the outer periphery of each of the opposed, reciprocating piston assemblies. Each pumping ring serves to pump air through the cooperating inlet, the supercharging chamber and the outlet into the intake manifold as the opposed piston assemblies reciprocate from the top dead center position to the bottom dead center position and back again. Advantageously, the integral reciprocating, combusting and supercharging piston assemblies deliver pressurized air to the intake manifold throughout the entire operating cycle of the engine without need to provide a separate supercharging fan driven by means of the output shaft. As such, component parts are reduced and reliability and overall efficiency of the engine power plant are effectively improved.

More preferably, the means for converting the reciprocating motion of the piston assemblies into the rotating motion of the drive shaft includes a stationary bearing block mounted to the engine block behind each reciprocating piston assembly. A cam is defined by a rear edge of the drive sleeve of the piston assembly. A pair of follower rollers mounted in the stationary bearing block engage this cam.

Additionally, it should be appreciated that the piston assemblies and drive shaft are connected so that the piston assemblies reciprocate with the drive shaft. In this way, an internal flywheel effect is provided to improve engine power and performance as well as efficiency. More particularly, a series of intermittently spaced drive races are connected to the drive sleeve of each piston assembly. Cooperating driven races are connected to the drive shaft. A drive ball bearing is received within each pair of cooperating races so that as the shaft turns the piston assemblies also turn.

In accordance with yet another aspect of the present invention, the internal combustion engine includes an inner cylinder member mounted to the drive shaft for engaging the piston assemblies and also defining an inner wall of the combustion chamber. Advantageously, this inner cylinder member provides a pathway for delivering coolant along the inner wall of the combustion chamber to provide better cooling. With the provision of means for circulating lubricating and cooling fluid also through the engine block and opposed piston assemblies, more effective overall cooling is provided so as to maintain and optimize the power output from the engine under substantially all operating conditions.

In accordance with yet another aspect of the present design, it should be appreciated that the reciprocating piston assemblies are concentrically disposed about the drive shaft so as to provide an annular combustion chamber. Through the provision of such a chamber, the chamber wall area is substantially increased over a convention cylinder design of equivalent displacement. Accordingly, the intake and exhaust port areas may also be increased to provide better air fuel charge flow into and exhaust gas flow from the combustion chamber. This not only improves performance and efficiency but substantially reduces the content of pollutants in the exhaust gases generated by the engine.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
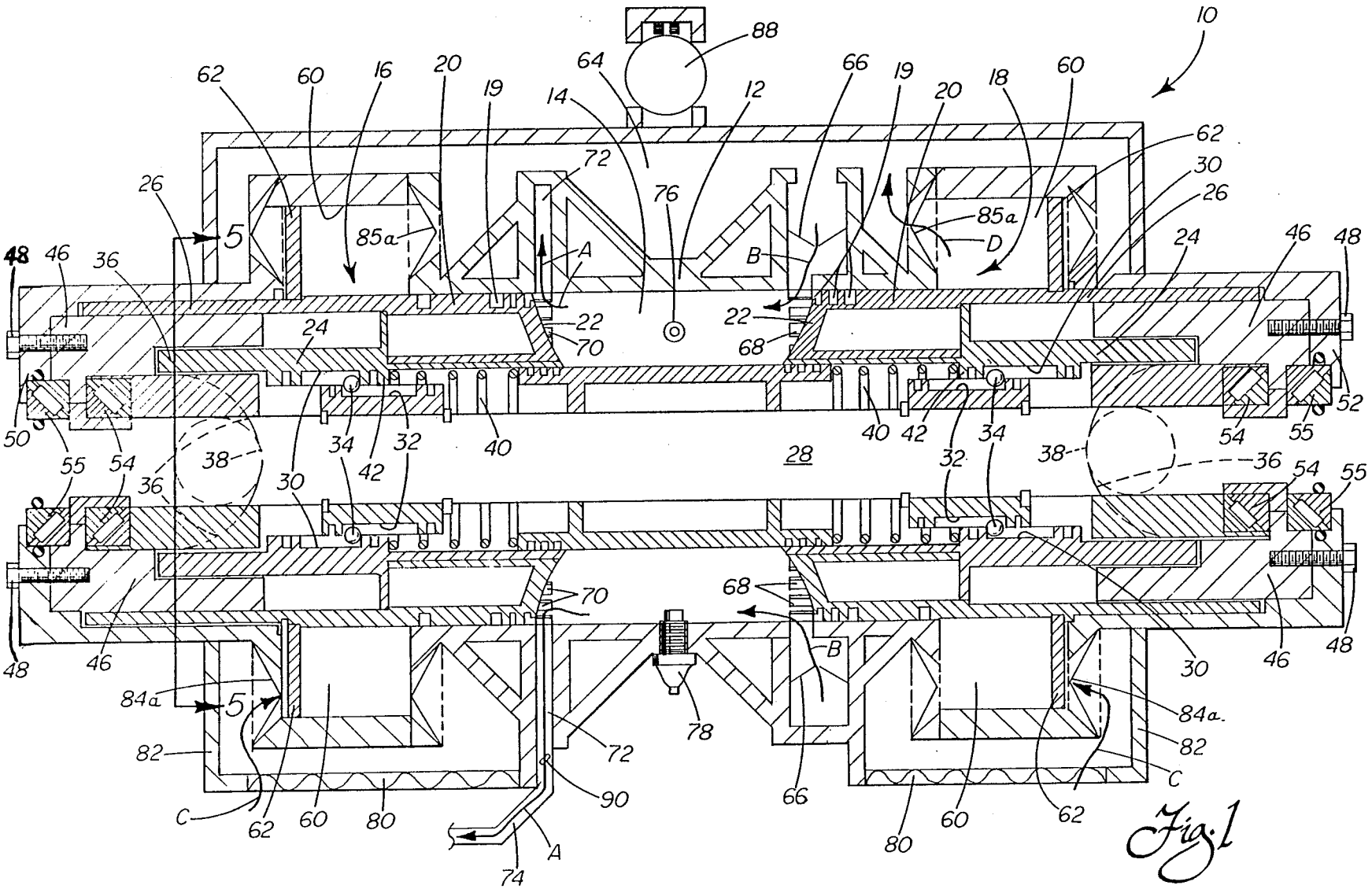
FIG. 1 is a longitudinal cross-sectional view of the engine of the present invention showing the piston assemblies in the bottom dead center position.
Figure 2:
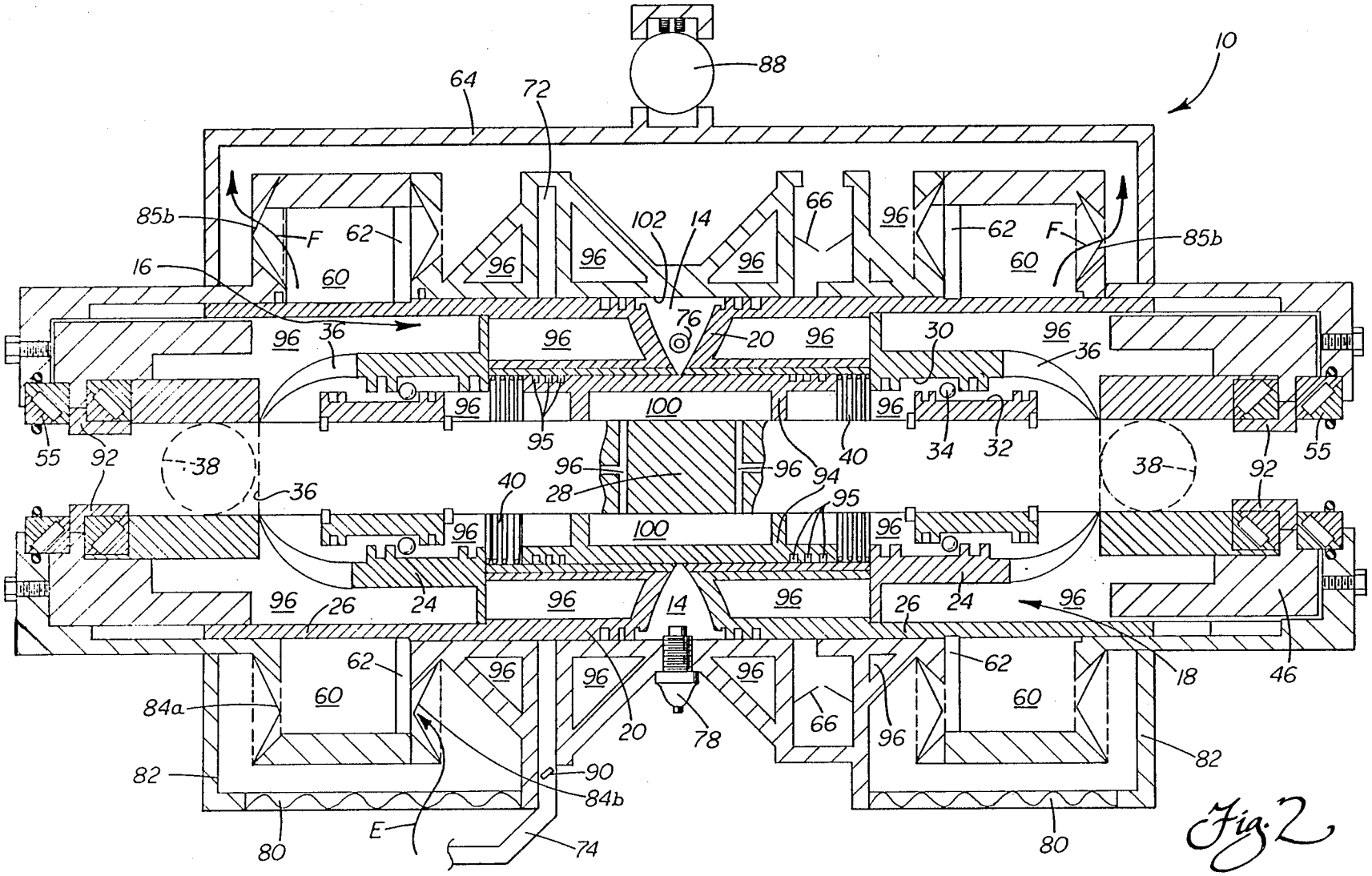
FIG. 2 is a longitudinal cross-sectional view of the present invention as shown in FIG. 1 showing the piston assemblies of the present invention in the top dead center position.
Figure 3:
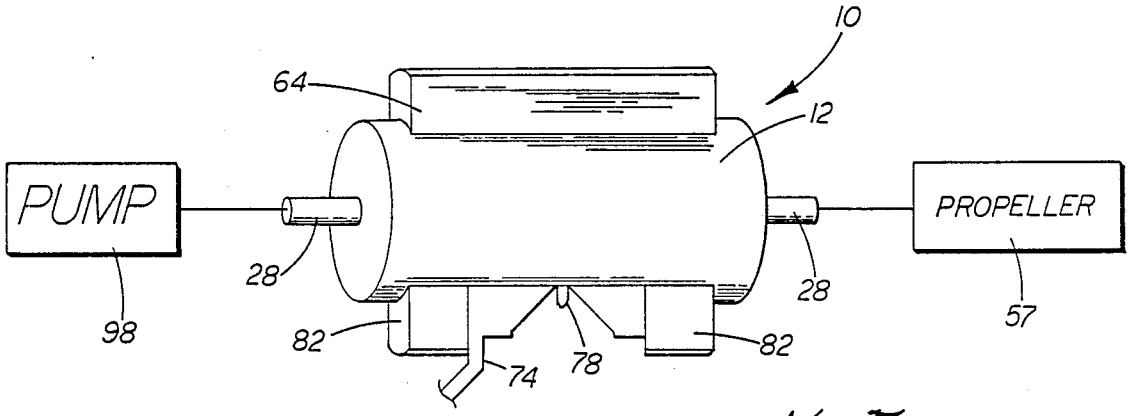
FIG. 3 is a partially schematical perspective view of the engine of the present invention.

Reference is now made to FIGS. 1–3 showing the internal combustion engine 10 of the present invention. As shown in these figures, the engine 10 comprises an engine block 12 including an annular combustion chamber 14. A pair of opposed, reciprocating piston assemblies 16, 18 are slidably received within the combustion chamber 14 which is sealed with the piston rings 19. As described in greater detail below, these piston assemblies 16, 18 reciprocate between the bottom dead center and top dead center positions shown in FIGS. 1 and 2 respectively.

Each piston assembly 16, 18 includes an annular piston head 20 having an inclined lead face 22 that slopes away toward the outer periphery of the piston head. A drive sleeve 24 and outer piston skirt 26 extend rearwardly from each piston head 20. Each piston may be cast from aluminum alloy or other appropriate metal in one piece as is known in the art.

The piston assemblies 16, 18 are operatively connected to a drive shaft 28 so that the reciprocating motion of the piston assemblies is converted into rotating motion of the drive shaft. More particularly, each drive sleeve 24 includes a series of drive races 30 (two shown in each piston assembly 16, 18 in FIGS. 1 and 2). A cooperating driven race 32 is formed in the drive shaft 28 for each drive race 30. As further shown, a drive ball bearing 34 is freely received within each cooperating drive race 30 and driven race 32 to interconnect the piston assemblies 16, 18 with the drive shaft 28. Through this connection, the piston assemblies 16, 18 rotate with and reciprocate along the drive shaft 28.

The reciprocating motion of the piston assemblies 16, 18 is controlled and limited as they rotate by means of a cam and follower arrangement that utilizes principles known in the art. More particularly, the trailing edge 36 of each drive sleeve 24 forms a cam profile. This cam profile edge 36 is biased into positive pressure engagement with a pair of cam follower rollers 38 by means of coil springs 40 which exert an outwardly directed force against the shoulder 42 of each drive sleeve 24.

As shown, the cam follower rollers 38 are mounted for rotation about shafts 44 attached to a stationary bearing block 46. The bearing block 46 is fixed to the engine block 12 by means of heavy duty bolts 48 extending through the engine block end sections 50, 52. Advantageously, the bolts 48 allow enough linear clearance to assure that no internal thrust load is transmitted to the engine block end sections 50, 52. Further, the thrust bearings 54 mounted to the bearing blocks 46 ensure that any thrust pressure exerted on the bearing blocks is harmlessly transmitted to the drive shaft 28. The drive shaft 28 is held for rotation in the engine block 12 by the thrust bearings 55 at each end section 50, 52.

As shown schematically in FIG. 3, the drive shaft 28 may extend from the engine block 12 at both ends. For example, in an airplane, the forward end of the drive shaft 28 may be connected to a propeller 57. The rear end of the drive shaft may be connected to a series of power take offs such as provided for a coolant and lubricant pump and/or a generator. Of course, a starter (not shown) may also be connected to the drive shaft 28.

The engine 10 is also equipped with a supercharging system. As shown, a pair of supercharging chambers 60 are provided in the engine block 12. One chamber 60 is concentrically disposed about each piston assembly 16, 18 around the combustion chamber 14. Each chamber 60 is sealed by means of the sealing rings 61. A pumping ring 62 is attached to the outer piston skirt 26 of each piston assembly 16, 18. Each pumping ring 62 extends substantially perpendicular to the skirt 26 into and across each supercharging chamber 60. The pumping rings 62 serve to pump air into and through the chambers 60 on each stroke of the piston assemblies 16, 18 as described in greater detail below.

The operational cycle of the engine 10 will now be discussed in detail beginning from the bottom dead center position shown in FIG. 1. Air from intake manifold 64 passes through a series of intermittently spaced one-way valves 66 (two shown in the drawing figures) through inlet ports 68 into the combustion chamber 14. This air initially scavenges the combustion chamber 14 forcing any exhaust gases from the cylinder through the exhaust ports 70 into the exhaust manifold 72. From there, the exhaust gases are directed through an exhaust pipe 74 as shown (note action arrows A in FIG. 1).

As the drive shaft 28 and piston assemblies 16, 18 continue to rotate, the cam profile edge 36 engaging the follower rollers 38 tends to force the piston assemblies 16, 18 toward one another. Initially, the exhaust ports 70 are closed while the delivery of air through the intake ports 60 continues for a short period of time until air at manifold pressure is provided in the combustion chamber 14. As the piston assemblies 16, 18 continue to move toward one another, the intake ports 68 are also closed and fuel is injected into the combustion cylinder 14 by one or more centrally located fuel injectors 76 as are known in the art.

As the piston assemblies 16, 18 continue to move toward the top dead center position shown in FIG. 2, the fuel/air mixture in the combustion chamber 14 is compressed. By selecting the desired cam profile of the trailing edge 36 of each piston assembly 16, 18 the dwell of the piston assemblies at the top dead center position (see FIG. 2) may be adjusted. More particularly, by increasing the duration of time over which the piston assemblies hold the top dead center position, the air/fuel charge burn time may be advanced and increased. As a result, the entire burn may be completed after the piston assemblies 16, 18 reach the top dead center position and, accordingly, loss of power and economy due to "kick-back" as prevalent in prior art engine designs when operating at high RPM's is avoided.

Once the piston assemblies 16, 18 reach the top dead center position shown in FIG. 2, one or more spark ignition means, such as spark plug 78, is actuated to ignite the air fuel charge. As the air/fuel charge burns, it expands thereby driving the piston assemblies 16, 18 back away from each other toward the bottom dead center position shown in FIG. 1. As this occurs, the inlet ports 68 are eventually uncovered by the piston assembly 18. The flow of pressurized exhaust gases through the inlet ports 68 into the intake manifold 64 is, however, prevented by the one-way valves 66.

Immediately subsequent to the uncovering of the inlet ports 68 by the piston assembly 18 is the uncovering of the exhaust ports 70 by the piston assembly 16. The exhaust gases from the burned air/fuel mixture move towards the exhaust ports 70 into the exhaust manifold 72. Of course, complete scavenging of the exhaust gases from the combustion cylinder 14 is assured, as discussed above, by the inrushing air from the intake manifold 64 (note action arrows B). Again, the dwell of the piston assemblies 16, 18 in any position at or near the bottom dead center position can be adjusted by providing a particular cam profile of the trailing edge 36 of either assembly 16, 18. In this way, the best scavenging may be provided, thereby increasing fuel efficiency and reducing the overall generation of pollutants by the engine.

As the piston assemblies 16, 18 and drive shaft 28 continue to rotate, the piston assemblies are again moved toward one another and the top dead center position as described above and the entire cycle is repeated.

Figure 5:
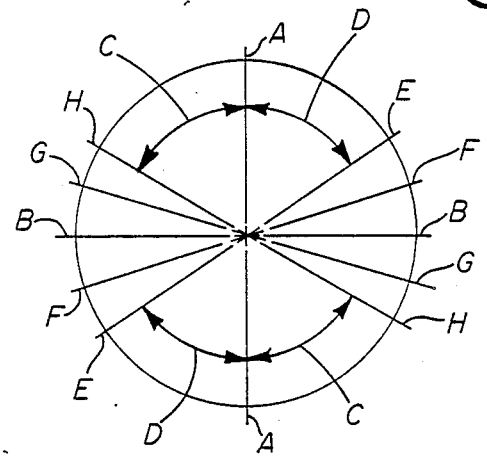
FIG. 5 is a schematical representation of the operating cycle of the engine of the present invention through one complete rotation of the drive shaft.
Figure 4:
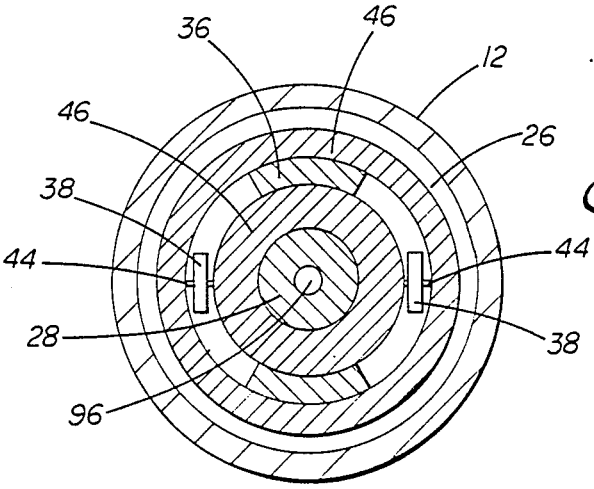
FIG. 4 is a cross-sectional view of a long line IV—IV of FIG. 3 detailing the bearing block and cam follower rollers of the engine of the present invention.

As best shown schematically in FIG. 5, this complete cycle occurs twice with each full rotation of the drive shaft 28. More particularly, in FIG. 5 a single 360° rotation of the drive shaft 28 is presented as a circle.

The piston assemblies 16, 18 are in the top dead center position at points A and in the bottom dead center position at points B. Compression of the air fuel mixture is developed during interval C while power is extracted during interval D. The intake ports open at points E while the exhaust ports open at points F. The exhaust ports close at points G trapping the full manifold pressure in the combustion chamber with the intake ports closing at points H. From a review of the schematical representation presented in FIG. 5 and the discussion of the operating cycle presented above, it should be appreciated that each piston assembly provides two power strokes with each revolution of the drive shaft. This unique feature of the present invention serves to further improve the overall horsepower of the invention for the given displacement.

It should be appreciated that as the piston assemblies 16, 18 reciprocate as described above, the integral pumping rings 62 are also providing a supercharging function. More specifically, as the piston assemblies 16, 18 move from the bottom dead center position of FIG. 1 to the top dead center position of FIG. 2, pumping rings 62 serve to draw air into the supercharging chamber 60 through the air filters 80 of intake boxes 82 and the one way valves 84A (note action arrows C). Simultaneously, air is being pumped by the pumping ring 62 from the supercharging chamber 60 into the intake manifold 64 through the one way valves 85A (note action arrows D). Similarly, as the piston assemblies 16, 18 move in the opposite direction from the top dead center to the bottom dead center position, air is drawn by the action of the pumping ring 62 into the supercharging chamber 60 through the one-way valves 84B (note action arrows E). Simultaneously, air is being pumped by the pumping ring 62 from the supercharging chamber 60 into the intake manifold through the one way valves 85B (note action arrows F). Thus, it should be appreciated that air at increased pressure is being pumped into the intake manifold as the piston assemblies 16, 18 reciprocate in either direction. Accordingly, maximum supercharging efficiency is achieved without requiring the utilization of a separate charging fan connected to the power shaft of the engine as required in many prior art designs.

In order to tune the performance parameters of the engine 10, a pressure relief valve 88 is connected to the intake manifold 64. The valve 88 limits the maximum air pressure in the intake manifold 64 to assure proper engine performance. Similarly, as is known in the art, an adjustable valve restrictor or gate 90 may be provided in the exhaust pipe 74 just beyond the exhaust manifold 72 to control the engine back pressure. Accordingly, it should be appreciated that the pressure relief valve 88, exhaust valve gate 90 and dwell controlling cam profile 36 may all be adjusted to fine tune engine operation and performance as required for a given application. Additionally, the compression ratio of the engine 10 may also be readily adjusted by utilizing different size shims 92 behind the bearing blocks 46.

Advantageously, it should also be appreciated that the present engine design provides superior cooling so as to maintain peak power output under substantially any operating conditions. More specifically, an inner cylinder member 94 is mounted to and rotates with the drive shaft 28. This inner cylinder member 94 includes sealing rings 95 that engage the piston assemblies 16, 18. Thus, as should be appreciated, the inner cylinder member 94 defines the inner wall of the annular combustion chamber 14. Cooling lubricant such as motor oil is circulated through various passages 96 in the engine block, piston assemblies 16, 18 and drive shaft 28 by means of a pump 98 driven through a power take-off connected to the drive shaft 28 as described above. As shown, the lubricant is directed along the drive shaft 28 and through the space 100 between the inner cylinder member 94 and the drive shaft 28 so as to provide cooling along the inner wall of the combustion chamber 14. Since cooling is also provided along the outer wall 102 of the combustion chamber 14 and in the piston assemblies 16, 18, cooling to substantially all sides of the combustion chamber 14 is provided. In this way, the most efficient cooling is assured so as to reduce overall engine operating temperatures and improve the power output of the engine.

From a review of the above description, it should be apparent that a number of other distinct advantages are provided by the unique design of the engine 10 of the present invention. More specifically, the utilization of an annular cylinder provides a significant increase in the cylinder wall area for a given engine displacement over prior art designs. Advantageously, this means that intake and exhaust ports of a larger overall area may be provided. As such, the rate of intake and exhaust flow into and out of the combustion chamber 14 is also greatly increased. This ensures that full scavenging and pressurizing of the chamber 14 always takes place even at relatively high RPM where this has been a problem with prior art designs. Accordingly, overall engine performance and efficiency are improved.

It should also be recognized that the inclined face 22 of the piston heads 20 improves flow and scavenging characteristics. More particularly, air entering the combustion chamber 14 through the intake port 68 is directed by the inclined face 22 of the piston assembly 18 outwardly into the chamber toward the piston assembly 16. Additionally, air forced toward the piston assembly 16 as a result of the incoming air charge is directed by the inclined face 22 (of assembly 16) toward the exhaust port 70. In this way, better, more efficient air flow is assured.

Additionally, it should be appreciated that by rotating the piston assemblies 16, 18 with the drive shaft 28, even chamber wear results. Further, an internal fly wheel effect is produced. The resulting inertial advantage serves to improve the performance and efficiency of the engine while assuring smooth, steady operation. Further, this is accomplished without incorporating a separate flywheel into the engine design as has been necessary in the prior art. As previously discussed, the present engine design is also self supercharging. The engine is additionally relatively simple in design and both easy to construct and maintain. It utilizes a minimum number of moving parts and as such also reduces the overall number of wear points. Thus, the engine is particularly reliable.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A two stage internal combustion engine, comprising:

an engine block including a combustion chamber having intake and exhaust ports;

a pair of opposed piston assemblies received for reciprocation within said combustion chamber between top dead center and bottom dead center positions;

an intake manifold in communication with said intake port;

means for firing a fuel/air charge in said combustion chamber;

a rotatable drive shaft;

means for connecting said piston assemblies and said drive shaft and for converting reciprocating motion of said piston assemblies into rotating motion of said drive shaft;

said engine being further characterized by:

a supercharging chamber associated with each piston assembly having an inlet in communication with an air intake and an outlet in communication with said intake manifold;

means received within each supercharging chamber for pumping air as said associated piston assemblies reciprocate in either direction between top dead center and bottom dead center positions; and valve means for controlling the flow of air being pumped by said pumping means through said inlets, supercharging chambers and outlets, said valve means allowing each said pumping means to simultaneously pump air from said air intake through said inlets into said associated supercharging chamber and from said associated supercharging chamber through said outlets into said intake manifold on each stroke of said associated piston assemblies.

2. The internal combustion engine of claim 1, wherein each of said piston assemblies includes an annular piston head received about said drive shaft.

3. The internal combustion engine of claim 2, further including a drive sleeve extending rearwardly from each said piston head.

4. The internal combustion engine of claim 3, wherein said piston assemblies and drive shaft connecting and converting means includes a stationary bearing block mounted to said engine block, a cam profile defined by a rear edge of said drive sleeve and a pair of follower rollers mounted in said bearing block for engaging said cam.

5. The internal combustion engine of claim 4, wherein said piston assemblies and drive shaft and connecting means further includes a drive race on said drive sleeve, a cooperating driven race connected to said drive shaft and a drive ball received in said races.

6. The internal combustion engine of claim 2, further including a piston skirt extending rearwardly from said piston head.

7. The internal combustion engine of claim 6, wherein said pumping means includes a pumping ring mounted to said piston skirt and extending substantially perpendicular thereto.

8. The internal combustion engine of claim 7, wherein one supercharging chamber is concentrically disposed about each said piston assembly.

9. The internal combustion engine of claim 7, including means between said piston assemblies and said engine block for sealing said combustion chamber and said supercharging chamber.

10. The internal combustion engine of claim 1, including means for circulating lubricating and cooling fluid through said engine block, opposed piston assemblies and drive shaft so as to provide cooling to said combustion chamber on substantially all sides.

11. The internal combustion engine of claim 10, including an inner cylinder member mounted to said drive shaft for engaging said piston assemblies and defining an inner wall of said combustion chamber, said inner cylinder member also providing a pathway for delivering cooling fluid along said inner wall of said combustion chamber for better cooling.

12. The internal combustion engine of claim 1, further including means for biasing said opposed piston assemblies to said bottom dead center position.

13. A two stage internal combustion engine, comprising:

an engine block including a combustion chamber having intake and exhaust ports;

a pair of opposed piston assemblies received for reciprocation within said combustion chamber between top dead center and bottom dead center positions;

an intake manifold in communication with said intake port;

means for firing a fuel/air charge in said combustion chamber;

a rotatable drive shaft;

means for connecting said piston assemblies and said drive shaft and for converting reciprocating motion of said piston assemblies into rotating motion of said drive shaft;

said engine being further characterized by:

each of said piston assemblies including an annular piston head received about said drive shaft in an annular combustion chamber providing increased intake port and exhaust port area for improved flow characteristics and including an inner cylinder member mounted to said drive shaft for engaging said piston assemblies and defining an inner wall of said combustion chamber, said inner cylinder member also providing a pathway for delivering cooling fluid along said inner wall of said combustion chamber for better cooling.

14. The two stage internal combustion engine of claim 13, further including a drive sleeve extending rearwardly from each said piston head.

15. The two stage internal combustion engine of claim 14, wherein said piston assemblies and drive shaft connecting and converting means includes a stationary bearing block mounted to said engine block, a cam profile defined by a rear edge of said drive sleeve and a pair of follower rollers mounted in said bearing block for engaging said cam.

16. The two stage internal combustion engine of claim 15, wherein said piston assemblies and drive shaft connecting and converting means further includes a drive race on said drive sleeve, a cooperating driven race on said drive shaft and a drive ball received in said races.

17. The two stage internal combustion engine of claim 13, including means for circulating lubricating and cooling fluid through said engine block, opposed piston assemblies and drive shaft so as to provide cooling to said combustion chamber on substantially all sides.

18. The two stage internal combustion engine of claim 13, further including means for biasing said opposed piston assemblies to said bottom dead center position.

* * * * *